US006390786B1

(12) United States Patent
Gennami et al.

(10) Patent No.: US 6,390,786 B1
(45) Date of Patent: May 21, 2002

(54) STRUCTURE FOR DAMPING PRESSURE PULSATIONS OF COMPRESSOR

(75) Inventors: Hiroyuki Gennami; Tomoji Tarutani; Taku Adaniya; Hirotaka Kurakake; Masaki Ota, all of Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/613,385

(22) Filed: Jul. 11, 2000

(30) Foreign Application Priority Data

Jul. 28, 1999 (JP) ..... 11-214215

(51) Int. Cl.[7] ..... F04B 11/00; F04B 1/14
(52) U.S. Cl. ..... 417/269; 417/540
(58) Field of Search ..... 417/269, 540

(56) References Cited

U.S. PATENT DOCUMENTS 4,407,638 A 10/1983 Sasaya et al. ..... 417/269
4,813,852 A * 3/1989 Ikeda et al. ..... 417/269
4,930,995 A 6/1990 Suzuki et al. ..... 417/312
5,236,312 A * 8/1993 Finn et al. ..... 417/269
5,533,870 A * 7/1996 Takenaka et al. ..... 417/269
5,533,871 A * 7/1996 Takenaka et al. ..... 417/269
5,702,236 A 12/1997 Ikeda ..... 417/269

FOREIGN PATENT DOCUMENTS

JP 64-56583 4/1989
JP 1-83188 6/1989
JP 05026168 A 2/1993

OTHER PUBLICATIONS

EP 00 11 3890 Search Report dated Sep. 18, 2001.

* cited by examiner

*Primary Examiner*—Michael Koczo
(74) *Attorney, Agent, or Firm*—Woodcock Washburn LLP

(57) ABSTRACT

According to the structure for damping the pulsations of discharge pressure of a compressor of the present invention, in the annular discharge chamber 28 divided on the outer circumferential side in the rear housing 5, two bulkhead sections 35 are extended from positions on both sides of the outlet 23 in the circumferential direction in such a manner that they are separate from each other. The end portion of each bulkhead section 35 is extended to halfway between the first discharge port section 20 and the second discharge port section 21. The flow path from the first discharge port section 20 to the outlet 23 is directed to the opposite side to the outlet 23 and then turned back to the outlet 23. Therefore, the length of the flow path from the first discharge port section 20 to the outlet 23 becomes relatively long.

5 Claims, 6 Drawing Sheets

STRUCTURE FOR DAMPING PRESSURE PULSATIONS OF COMPRESSOR

BACKGROUND OF THE INVENTION

1. Field of the Invention

The present invention relates to a compressor used for an air-conditioner or refrigerator.

2. Description of the Prior Art

Conventionally, a compressor of this type is incorporated into an air-conditioner for vehicle use and discharges refrigerant gas from its discharge port when it is operated. As shown in FIG. 7, the compressor 51 includes a discharge pipe connecting section 52 with which a pipe (not shown) is connected. A discharge opening 53 is provided in this discharge pipe connecting section 52. A plurality of cylinder bores 55, which are formed on a circle which has the same center with the housing 54 at regular intervals, are communicated with a discharge chamber 57 via discharge ports 56. The discharge chamber 57 is formed in the outer circumferential section of the housing 54. When a swash plate (not shown) is rotated and the pistons (not shown) housed in the cylinder bores 55 are successively reciprocated in the cylinder bores 55, the refrigerant gas flows out from the discharge chamber 57 into an external refrigerating circuit (not shown) via a pipe.

In this type compressor 51 having the plurality of cylinder bores 55, the refrigerant gas is discharged into the discharge chamber 57 at regular intervals, and pulsations of discharge pressure are generated because pressure in the discharge chamber 57 fluctuates at the time when the refrigerant gas is discharged from each cylinder bore 55. When the pulsations of the discharge pressure are generated, the pipe and condenser connected with the compressor 51 vibrate, that is, vibration and noise are caused by resonance. In order to reduce the occurrence of vibration and noise, the conventional compressor is provided with a damping device by which the pulsations of discharge pressure can be damped.

In this type compressor 51, it is difficult to damp the high frequency components contained in the pulsations of discharge pressure which are occurred when the refrigerant gas flows through the discharge port 56 located close to the discharge pipe connecting section 52. Accordingly, in order to effectively damp the high frequency components, there is provided a method in which a muffler chamber is arranged in the rear housing.

However, the above method is disadvantageous in that the size of the compressor is increased when the muffler chamber is arranged in the compressor body for damping the pulsations of discharge pressure.

SUMMARY OF THE INVENTION

The present invention has been accomplished to solve the above problems. It is an object of the present invention to provide a simple structure for damping the pulsations of discharge pressure of a compressor without increasing the size of the compressor.

A structure for damping the pulsations of discharge pressure of a compressor of the present invention comprises: a housing including a cylinder block, in which a plurality of cylinder bores for housing reciprocating pistons are formed, and a valve forming body, for closing one end of each cylinder bore, joined to the cylinder block so that a compression chamber can be defined in each cylinder bore; a communicating chamber defined in the housing so that it can be communicated with the cylinder bores; a plurality of port sections formed in the valve body so that they can communicate the cylinder bores with the communicating chamber; and a connecting opening formed on an outer wall of the housing so that the communicating chamber can be communicated with the outside of the housing, wherein a partitioning section, for bending a refrigerant gas flow path from one of the plurality of port sections, which is located at the closest position to the connecting opening, to the connecting opening, is arranged in the communicating chamber.

Due to the above structure, the flow path of refrigerant gas from the port section to the connecting opening is bent by the partitioning section formed in the communicating chamber. Therefore, the length of the flow path can be relatively extended. As a result, the pulsations of discharge pressure can be damped without an increase in the size of the compressor.

The present invention may be more fully understood from the description of the preferred embodiments of the invention set forth below together with the accompanying drawings.

BRIEF DESCRIPTION OF THE DRAWINGS

In the drawings:

FIG. 1 is a cross-sectional view taken on line I—I in FIG. 2;

DESCRIPTION OF THE PREFERRED EMBODIMENTS

Figure 1:
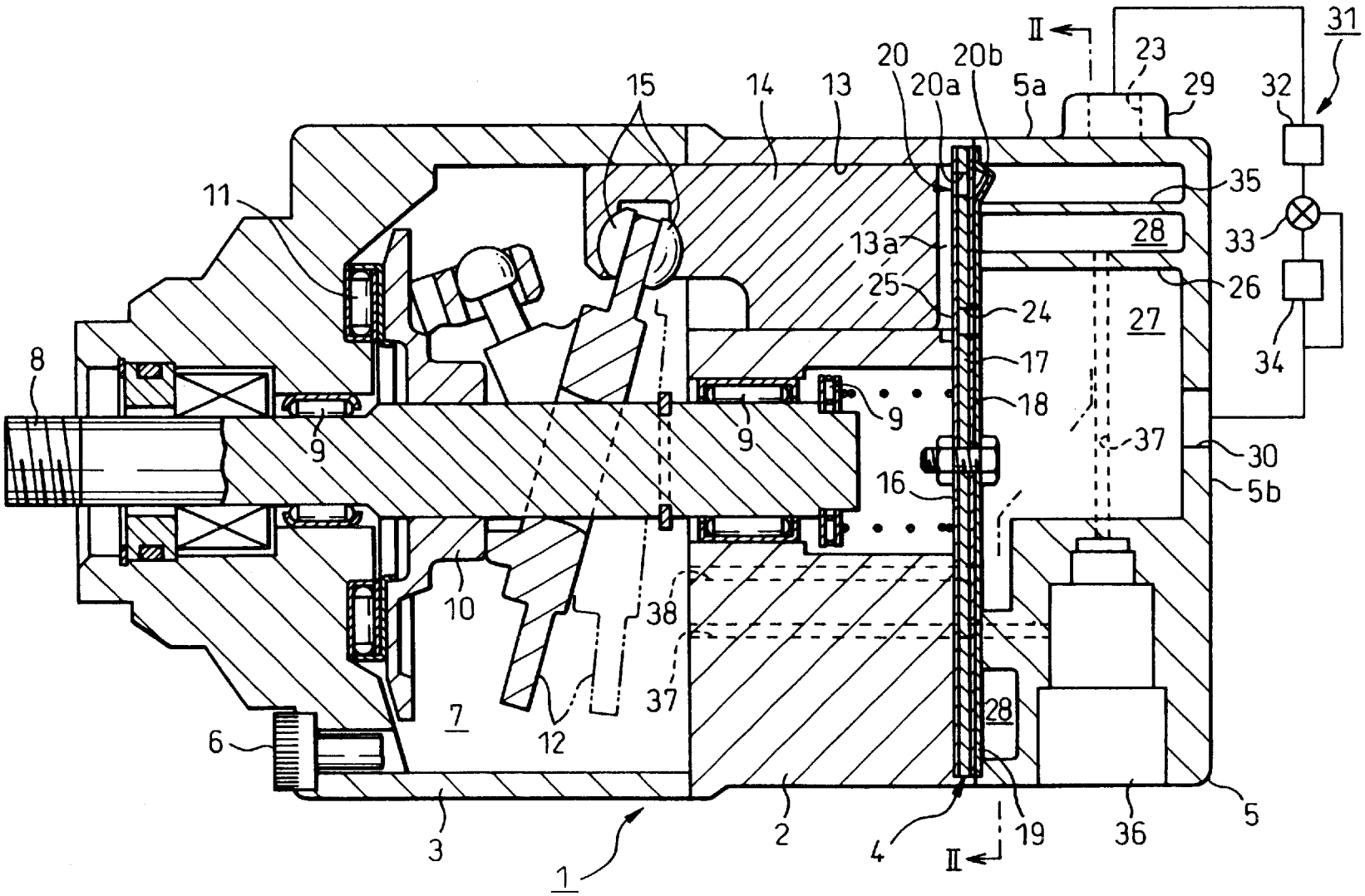
FIG. 1 is a cross-sectional side view of a compressor of an embodiment of the present invention, that is.
Figure 2:
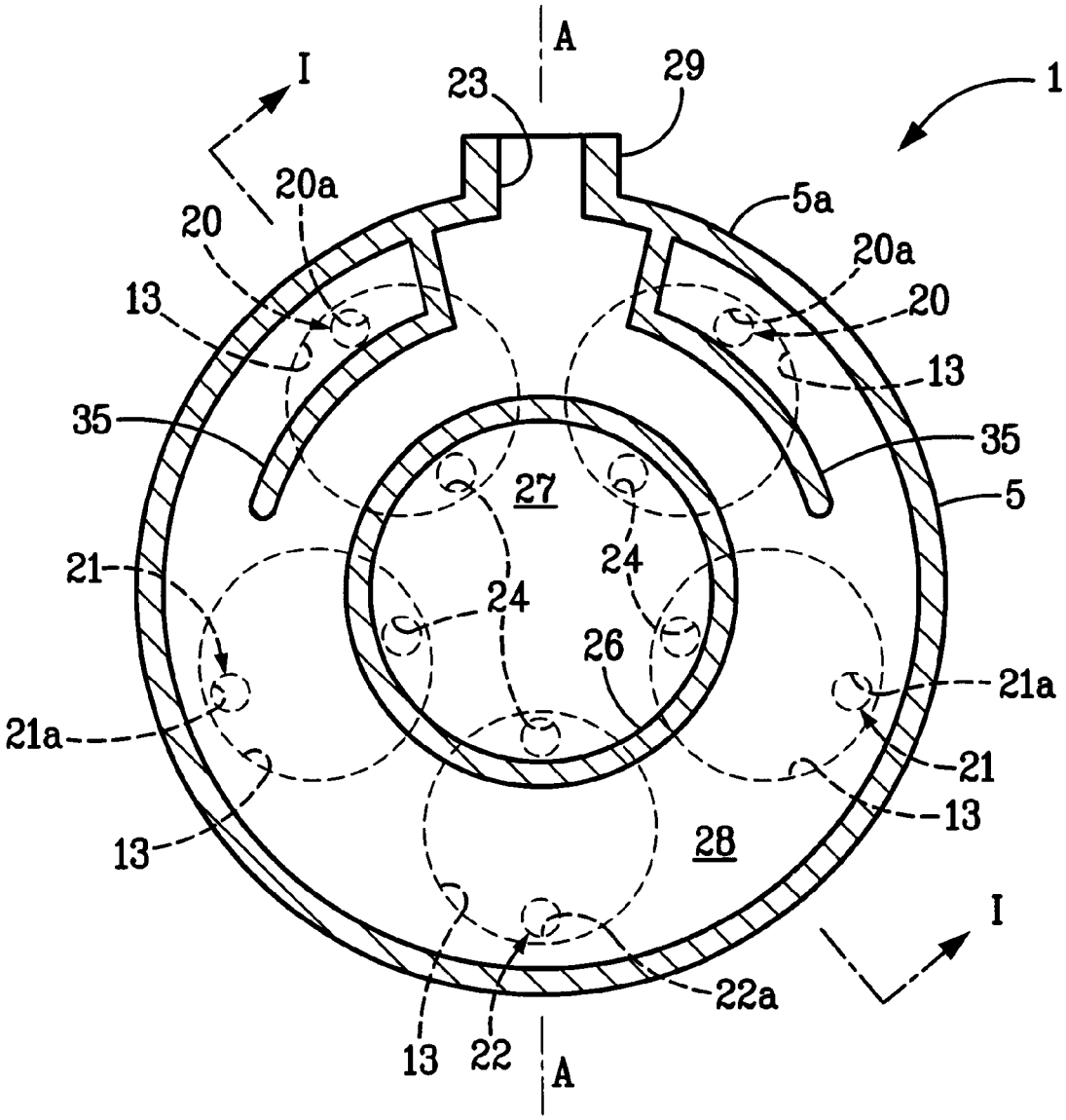
FIG. 2 is a cross-sectional view taken on line II—II in FIG. 1.

Referring to FIGS. 1 and 2, an embodiment will be explained below in which the present invention is applied to a variable capacity type compressor.

As shown in FIG. 1, the compressor 1 includes: a cylinder block 2; a front housing 3 joined to the front end face of the cylinder block 2; and a rear housing 5 joined to the rear end face of the cylinder block 2 via a valve forming body 4. The cylinder block 2, front housing 3, valve forming body 4 and rear housing 5 are joined and fixed to each other by a plurality of through-bolts 6 and compose a main housing of the variable capacity type compressor.

There is provided a crank chamber 7 in the region surrounded by the cylinder block 2 and the front housing 3. A drive shaft 8 is arranged in the crank chamber 7. This drive shaft 8 is rotatably supported by bearings 9 which are arranged on the inner circumferential faces of the cylinder block 2 and the front housing 3. A forward end of the drive shaft 8 is connected with an external drive source (not shown) such as an engine, for example, via an electromagnetic clutch (not shown).

A rotary support body 10 fixed to the drive shaft 8 is supported by bearings 11 provided on the inner face of the front housing 3, so that the rotary support body 10 can be rotated integrally with the drive shaft 8. A swash plate 12 is engaged with the drive shaft 8 in such a manner that the swash plate 12 can be rotated integrally with the drive shaft 8 and tilted with respect to the drive shaft 8.

In the cylinder block 2, a plurality of cylinder bores 13 are formed around the drive shaft 8 in the axial direction and at regular intervals. A single head type piston 14 accommodated in each cylinder bore 13 is connected with the swash plate 12 via shoes 15 on the base end side of the piston 14. When the rotary motion of the swash plate 12 is converted into a linear motion, the single head type piston 14 housed in each cylinder bore 13 can be reciprocated in the longitudinal direction. A compression chamber 13*a* is defined by the inner circumferential face of the cylinder bore 13, the end face of the piston 14 and the valve forming body 4.

As shown in FIG. 1, the valve forming body 4 includes a suction valve plate 16, valve plate 17, discharge valve plate 18 and retainer plate 19. As shown in FIG. 2, in the valve body 4, there are provided discharge port sections 20, 21, 22 at positions opposed to the cylinder bores 13 on the external side of the valve body 4 in the radial direction. Concerning the discharge port sections 20, 21 and 22, there provided a first discharge port section 20, second discharge port section 21 and third discharge port section 22 arranged in this order from an outlet 23 which is a connecting opening formed on the circumferential wall 5*a* of the rear housing 5. The discharge port sections 20, 21, 22 are composed of discharge ports 20*a*, 21*a*, 22*a* formed on the valve plate 17, and discharge valves 20*b* formed on the discharge valve plate 18. In this case, the discharge valve 20*b* is illustrated in FIG. 1, however, the discharge valves opposed to the discharge ports 21, 22 are not illustrated in the drawing. The discharge port sections 20, 21, 22 are arranged on the same circle, the center of which is the axis of the housing, at regular intervals. Concerning the rear housing 5, a cross section of the rear housing 5 perpendicular to its axis is symmetrical with respect to line A—A in FIG. 2.

On the valve plate 17, there are provided a plurality of suction ports 24 at positions opposed to the cylinder bore 13 on the internal side in the radial direction. As shown in FIG. 2, the suction ports 24 are arranged on the same circle, the center of which is the axis of the housing, at regular intervals. On the suction plate 16, the suction valves 25, which are illustrated in FIG. 1, are arranged at positions opposed to the suction ports 24.

As shown in FIGS. 1 and 2, there is provided a partition 26 in the rear housing 5. Also, there is provided a suction chamber 27 in the inner circumferential section of the partition 26, and also there is provided a discharge chamber 28 on the outer circumferential section of the partition 26. This discharge chamber 28 is a defined chamber arranged on the outer circumferential side. The suction chamber 27 is communicated with the cylinder bores 13 via the suction ports 24 and the suction valves 25. The discharge chamber 28, as a communicating chamber, communicates with the cylinder bores 13 via the discharge ports 20*a*, 21*a*, 22*a* and the discharge valve 20*b*.

On the circumferential wall 5*a* of the rear housing 5, there is provided a connecting section 29 for the discharge pipe. As the connecting opening of this connecting section 29 for the discharge pipe, there is provided the outlet 23. As shown in FIG. 1, on the end wall 5*b* of the rear housing 5, there is provided an inlet 30 for communicating the suction chamber 27 with the outside of the rear housing 5. Outside the housing 5, there is provided an external refrigerating circuit 31 between the outlet 23 and the inlet 30. The external refrigerating circuit 31 is connected with the outlet 23 and the inlet 30 via pipes (not shown). The external refrigerating circuit 31 includes a condenser 32, expansion valve 33 and evaporator 34. After the refrigerant gas has been discharged into the discharge chamber 28, it flows out from the outlet 23 and flows into the inlet 30 via the external refrigerating circuit 31.

As shown in FIG. 2, in the discharge chamber 28, there is provided a partitioning section 35 extending in the axial direction in the rear housing 5. Further, on the inner circumferential face of the rear housing 5, the partitioning sections 35 are arranged at positions on both sides of the outlet 23 in the circumferential direction and extended from the circumferential wall 5*a* in such a manner that the partitioning sections 35 are separate from each other. The end portions of the partitioning sections 35 respectively extend to halfway between the first 20 and the second discharge port section 21. Further, each partitioning section 35 closes the first discharge port section 20 on the outlet 23 side. Therefore, the flow path of refrigerant gas discharged from the first discharge port section 20 is directed to the opposite side to the outlet 23 and then turns back to the outlet 23. Accordingly, the length of the flow path of refrigerant gas is relatively long.

As shown in FIG. 1, there is provided a control valve 36 in the rear housing 5. The control valve 36 is arranged on the pressure supply passage 37 communicating the crank chamber 7 with the discharge chamber 28. The crank chamber 7 and the suction chamber 27 are communicated with each other by the pressure releasing passage (throttling passage) 38. The discharge capacity of the variable capacity type compressor 1 can be controlled by adjusting the inclination of the swash plate 12 when the pressure (crank pressure) in the crank chamber 7 is controlled by adjusting the degree of opening of the control valve 36. When the crank pressure is adjusted to be high, the inclination of the swash plate 12 is decreased, and the stroke of the piston 14 is reduced, so that the discharge capacity can be reduced. When the crank pressure is adjusted to be low, the inclination of the swash plate 12 is increased, and the stroke of the piston 14 is increased, so that the discharge capacity can be increased.

In this embodiment, the flow path of refrigerant gas discharged from the first discharge port section 20 is bent when the partitioning section 35 is arranged. Therefore, the length of the path from the first discharge port section 20 to the outlet 23 can be extended. When the length of the path is extended, the high frequency components in the pulsations of discharge pressure are damped. Therefore, the high frequency components in the pulsations of discharge pressure from the first discharge port section 20 can be damped. Accordingly, compared with the conventional structure in which the muffler chamber is formed in the housing, the structure of the invention is advantageous in that the vibration of the pipe and condenser 32 and noise is suppressed, without increasing the size of the housing.

Accordingly, this embodiment can provide the following effects.

(1) In the discharge chamber 28, a partitioning section 35 is arranged which extends from a position close to the outlet 23 to a position exceeding the first discharge port section 20. Therefore, the flow path from the first discharge port section 20 to the outlet 23 is bent, and the length of the flow path is relatively extended. Accordingly, the high frequency components in the pulsation of discharge pressure can be damped. In this embodiment, only the partitioning section 35 is extended and formed in the discharge chamber 28. Therefore, it is possible to provide a damping effect by a simple structure without increasing the size of the compressor.

(2) The end portion of the partitioning section 35 extends to a position located at the center between the first discharge port section 20 and the second discharge port section 21. Therefore, the length of the path of refrigerant gas, which starts from the first discharge port section 20 to the opposite side to the outlet 23 and turns back to the outlet 23, becomes approximately the same as the length of the flow path from the second discharge port section 21 to the outlet 23. As a result, the high frequency components in the pulsations of discharge pressure caused by the first discharge port section 20 can be effectively damped.

(3) The profile of the partitioning section 35 is formed in such a manner that only the length of the flow path from the first discharge port section 20 is extended. Therefore, the partitioning section 35 does not affect the flow paths of the second 21 and the third discharge port section 22. As a result, it is possible to prevent the discharge resistance of the refrigerant gas, which is discharged from the second 21 and the third discharge port section 22, from increasing.

(4) The partitioning section 35 extends from the bottom face of the rear housing 5 in the same direction as that of the circumferential wall 5*a* and the partitioning 26, that is, the partitioning section 35 extends in the axial direction of the housing. Therefore, the rear housing 5 can be easily released from the mold in the process of manufacturing the rear housing 5.

In this connection, the present invention is not limited to the above specific embodiment. For example, the following variations may be made.

Figure 3:
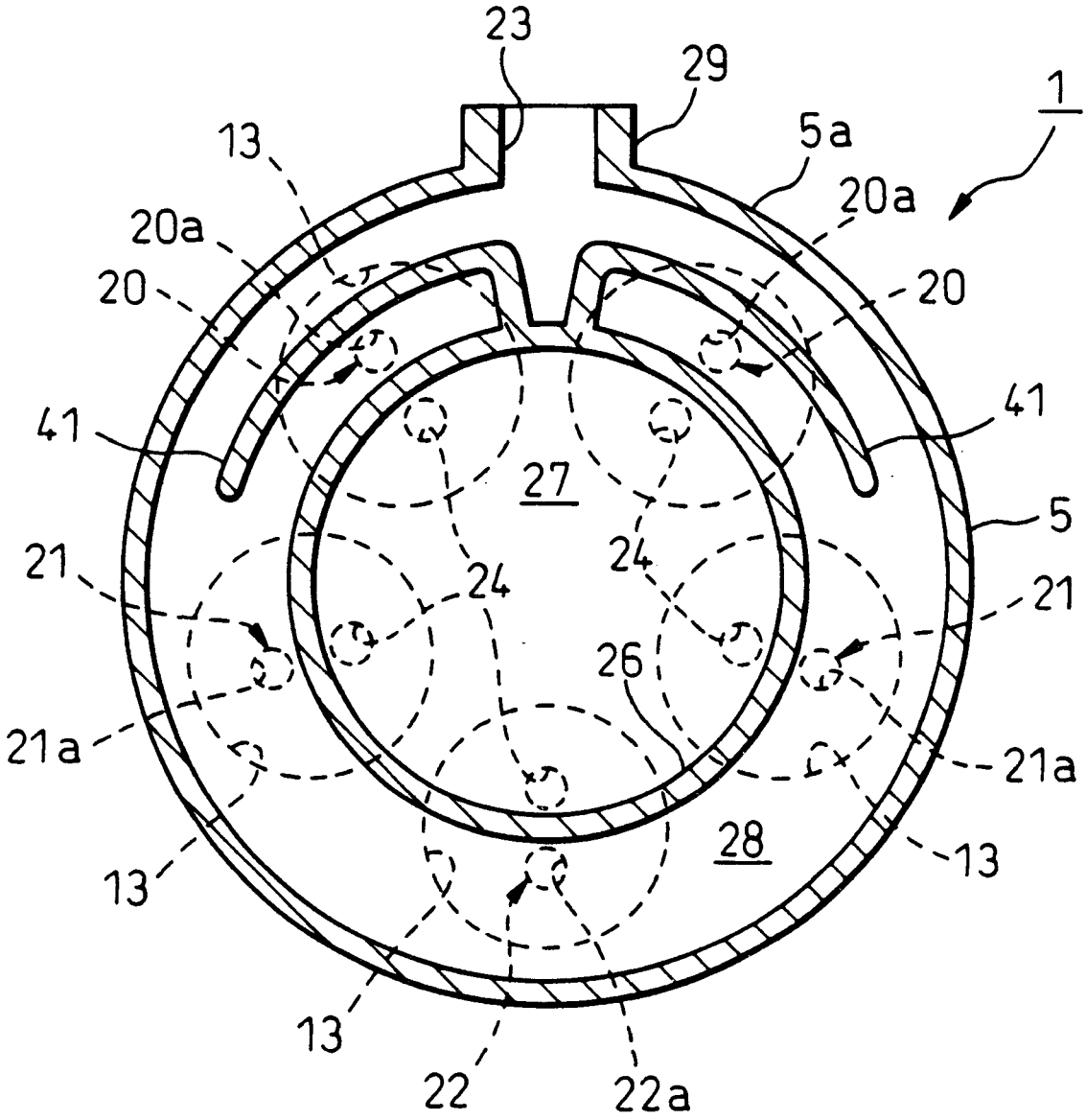
FIG. 3 is a cross-sectional view of a rear housing of another embodiment of the present invention.

The partitioning sections to bend the flow path of refrigerant gas are not limited to the partitioning sections 35 of this embodiment extending from both sides of the outlet 23. For example, as shown in FIG. 3, the partitioning sections may be the partitioning sections 41 extending from the partitioning 26 which divides the suction chamber 27 from the discharge chamber 28.

Figure 4:
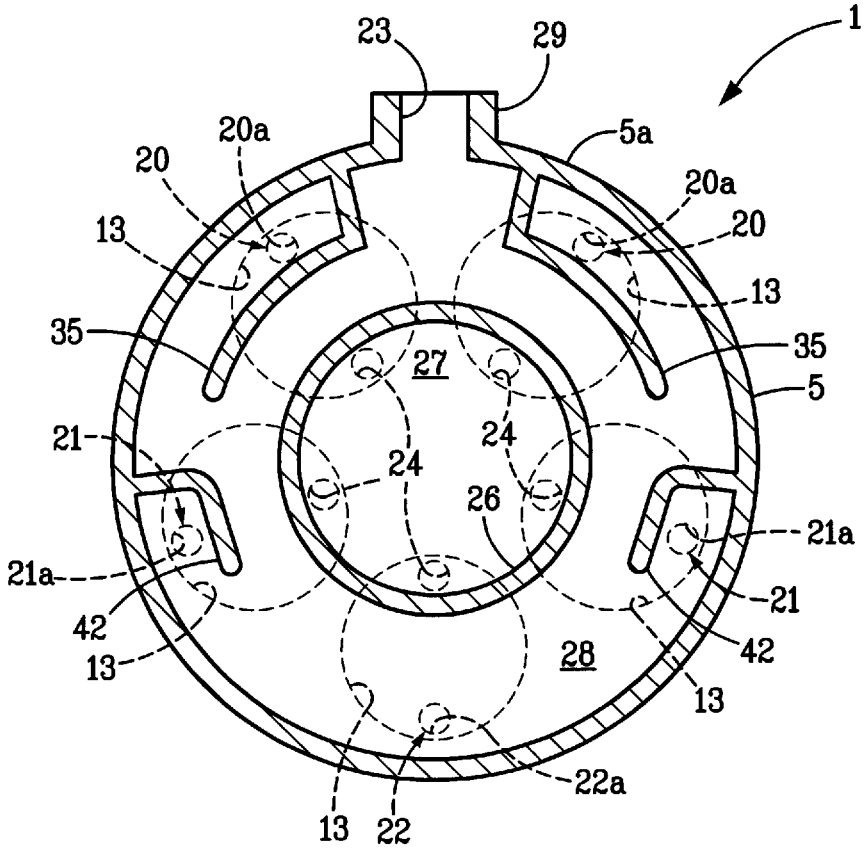
FIG. 4 is a cross-sectional view of a rear housing of still another embodiment of the present invention.

It is not necessary that partitioning section is formed only in the first discharge port section. The partitioning section 35 may be formed close to the first discharge port section 20 and also the partitioning section 42 may be formed close to the second discharge port section 21 as shown in FIG. 4. In the case where the high frequency components in the pulsations of discharge pressure from the second discharge port section cause noise, it is possible to damp the frequency components in the pulsations of discharge pressure from the second discharge port section 21 by the above structure. Therefore, the occurrence of noise can be positively prevented.

Figure 5A:
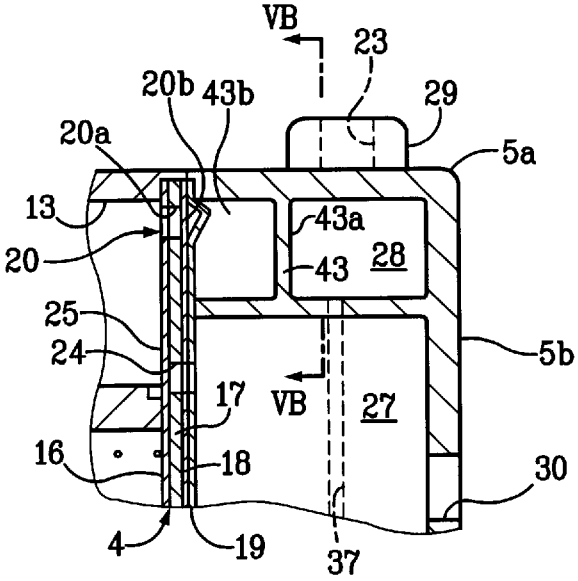
FIG. 5A is a cross-sectional side view of a portion of a compressor of still another embodiment.
Figure 5B:
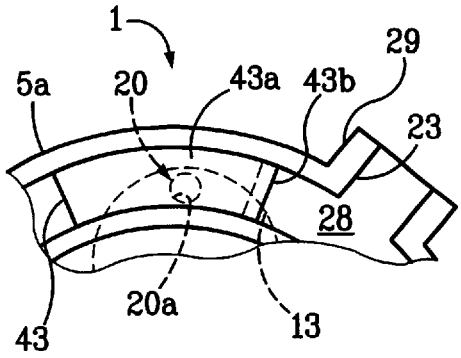
FIG. 5B is a partial cross-sectional view taken on line VB—VB in FIG. 5A.

Further, it is not necessary that the partitioning section extends in the same direction as that of the circumferential wall 5*a* of the rear housing 5 and the partition 26. For example, as shown in FIGS. 5A and 5B, the wall section 43 includes: a wall section 43*a* to divide the discharge chamber 28 into two portions in the axial direction of the housing at a position opposed to the first discharge port section 20; and a wall section 43*b* to close the outlet 23 side of the first discharge port section 20. In this case, it is necessary to use a core in the process of casting, or it is necessary to make the partitioning section 43 a different member from the rear housing 5 and assemble the partitioning section 43 to the rear housing 5 later. However, this structure is advantageous in that the pulsations of discharge pressure can be damped.

Figure 6:
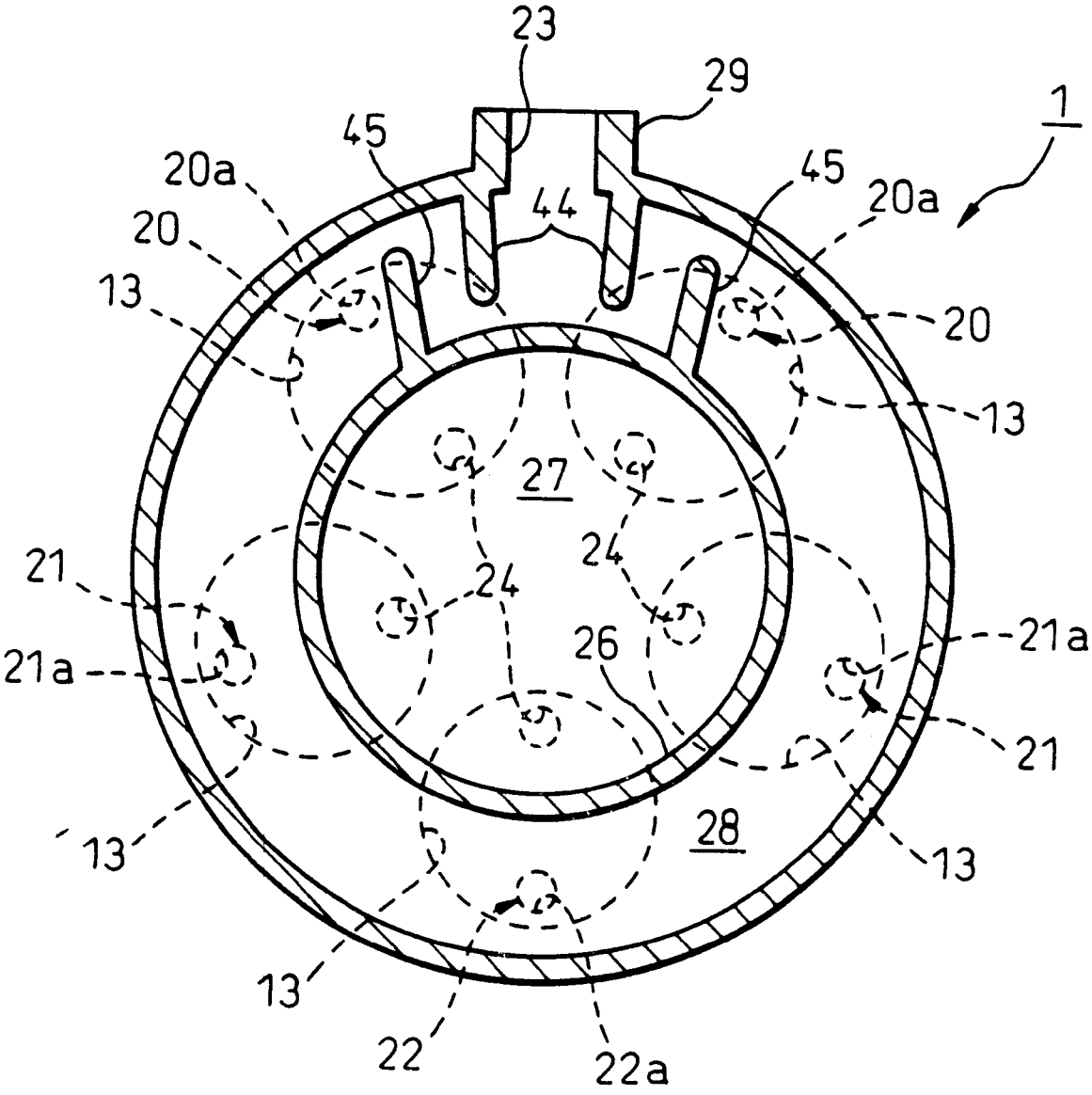
FIG. 6 is a cross-sectional view of a rear housing of still another embodiment.
Figure 7:
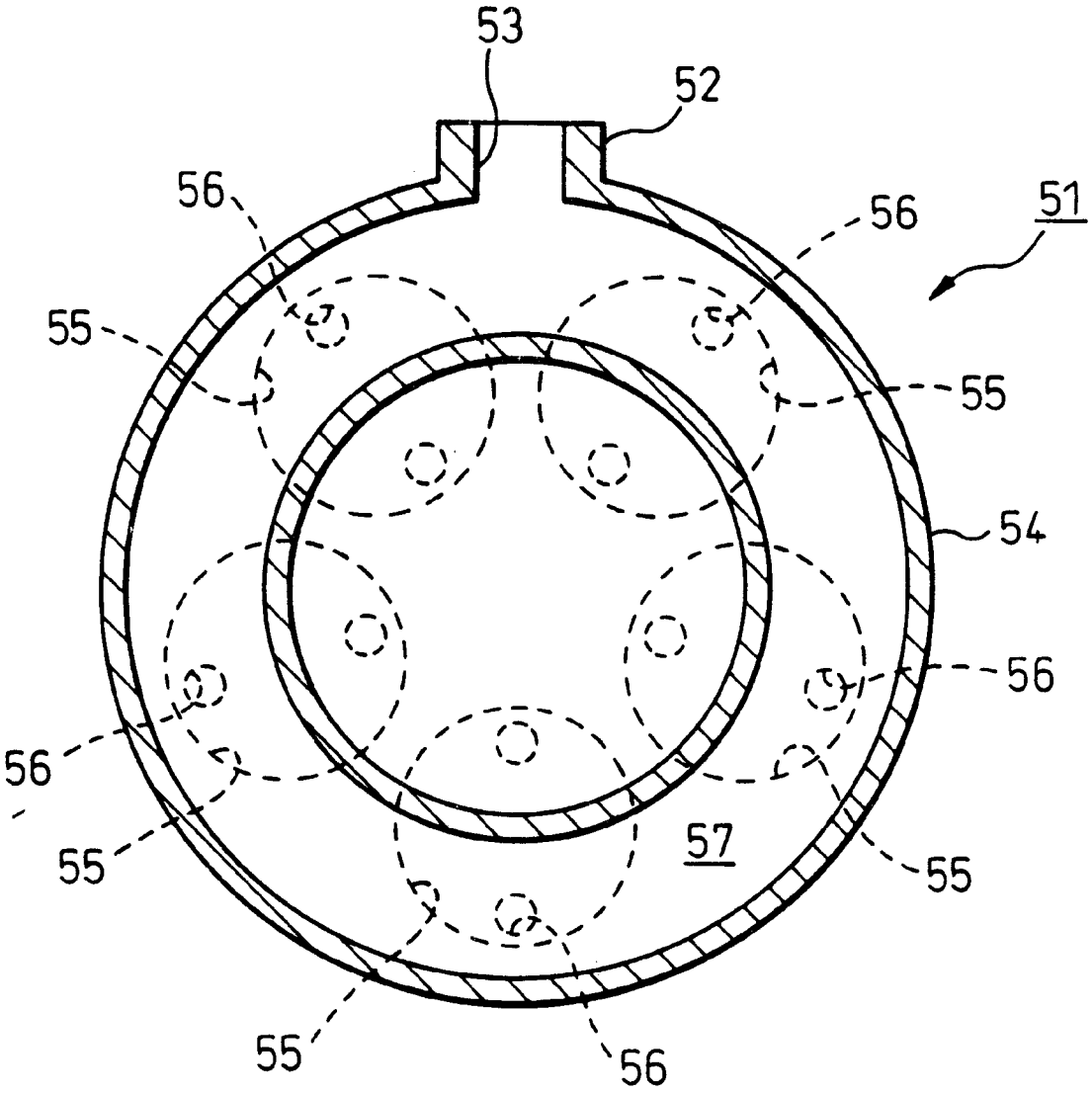
Fig.7 PRIOR ART
FIG. 7 is a cross-sectional view of a rear housing of a conventional compressor.

The profile of the partitioning section 35 is not limited to the profile of that of the above embodiment. For example, as shown in FIG. 6, in the discharge chamber 28, the extending section 44 is formed in such a manner that both sides of the outlet 23 in the circumferential direction are extended, and the extending section 45 is formed in such a manner that the extending section 45 is extended from the partition 26 at positions located on the outside in the circumferential direction with respect to the extending section 44. Due to the above structure, the flow path from the first discharge port section 20 to the outlet 23 can be bent into an S-shaped profile by the extending sections 44, 45. Accordingly, the length of the path can be extended. Therefore, when the above structure is adopted, the high frequency components of the pulsations of discharge pressure can be damped.

The divided chamber on the outer circumferential side is not limited to the discharge chamber 28. The divided chamber on the outer circumferential side may be the suction chamber 27. In this case, the compressor is composed in such a manner that the discharge chamber 28 is arranged in the inner circumferential section of the rear housing 5 and the suction chamber 27 is arranged in the outer circumferential section of the rear housing 5. Even when the partitioning section is arranged in the suction chamber, it is possible to damp the pulsations of suction pressure by the self-excited vibration of the suction valve 25. In this connection, the suction port section is composed of a suction port 24 and a suction valve 25.

It is not necessary that the partitioning section is formed in the outer circumferential side divided chamber. The discharge chamber 28 may be located at the inner circumferential section of the rear housing 5, and the partitioning section may be formed in the discharge chamber 28. In this case, the partitioning section may be arranged in the middle between each discharge port and the outlet 23, and the path may be bent. For example, even in the case where the outlet 23 is located at the center of the end wall of the rear housing 5 and a distance from the outlet 23 to each discharge port is substantially equal, when the high frequency components in the pulsations of discharge pressure are caused because the flow path is short, it is possible to arrange the partitioning section so that the flow paths can be extended with respect to all the discharge ports. In the case where the outlet 23 is shifted from the center of the end wall 5*b* of the rear housing 5 and the length of the flow path of each discharge port is different from each other, the partitioning section can be formed so that the flow path from the discharge port located at the closest position to the outlet 23 can be extended.

Further, the partitioning section may be arranged in both the discharge chamber 28 and the suction chamber 27. Due to the above structure, it is possible to damp both the pulsations of suction pressure and the pulsations of discharge pressure.

Further, it is not necessary that the partitioning section 35 extends to the center between the first discharge port section 20 and the second discharge port section 21. As long as the flow path of refrigerant gas discharged from the first discharge port section 20 can be bent by the partitioning section 35, the partitioning section 35 is not necessarily extended to halfway between the discharge port sections 20, 21.

As long as the compressor is provided with one connecting port and a plurality of port sections, the structure for damping the pulsation of discharge pressure of this embodiment can be applied to any type compressor.

The embodiment of the present invention is not limited to the compressor 1, the number of the cylinder bores 13 of which is five (five cylinders). That is, the structure for damping the pulsation of discharge pressure of this embodiment can be applied to a compressor, the number of the cylinders of which is except for five.

The compressor is not limited to the variable capacity type compressor or the single head piston type compressor. For example, the structure for damping the pulsation of discharge pressure of this embodiment can be applied to a fixed capacity type compressor or a double head piston type compressor.

As described above in detail, according to the present invention, the partitioning section is arranged in the communicating chamber. Therefore, it is possible to damp the pulsations of discharge pressure by a simple structure without increasing the size of a compressor.

According to the present invention, even in the structure in which it is difficult to damp the pulsations of discharge pressure of the port section, which is located at a position close to the connecting opening, because the length of the flow path from each port section to the connecting opening is different, the pulsations of discharge pressure can be damped.

According to the present invention, the flow path of the port section in a plurality of flow paths, the pulsations of discharge pressure of which must be damped, can be selectively extended. Therefore, the pulsations of discharge pressure can be damped without increasing the flow resistance of other port sections.

According to the present invention, the flow path of refrigerant is directed to the opposite side to the connecting opening and then turned back. Therefore, the length of the flow path can be relatively extended.

Further, according to the present invention, the length of the flow path from the port section which is the closest to the connecting opening is approximately the same as the length of the flow path from the port section which is the second closest to the connecting opening. Therefore, the pulsations of discharge pressure can be effectively damped.

While the invention has been described by reference to specific embodiments chosen for purposes of illustration, it should be apparent that numerous modifications could be made thereto by those skilled in the art without departing from the basic concept and scope of the invention.

What is claimed is:

1. A structure for damping the pressure pulsations of a compressor comprising:

a housing including a cylinder block, in which a plurality of cylinder bores for accommodating a reciprocating piston are formed, and a valve forming body for closing one end of each cylinder bore and joined to the cylinder block so that a compression chamber can be formed in each cylinder bore;

a communicating chamber defined in the housing so that it can be communicated with the cylinder bores;

a plurality of port sections formed in the valve body so that they can communicate the cylinder bores with the communicating chamber; and a connecting opening formed on an outer wall of the housing so that the communicating chamber can be communicated with the outside of the housing, wherein a partitioning section is arranged at a position between the connecting opening and a closet port section to the connecting opening, and the partitioning section extends away from the connecting opening, and wherein an end of the partitioning section is located in a range between the closest port section to the connecting opening and a second closest port section to the connecting opening.

2. A structure for damping the pressure pulsations of a compressor according to claim 1, wherein a partition for dividing the communicating chamber into outer and inner circumferential chambers is formed in the housing, and the partitioning section is formed at least in an annular outer circumferential chamber.

3. A structure for damping the pressure pulsations of a compressor according to claim 1, wherein the partitioning section extends from an inner face of the housing.

4. A structure for damping the pressure pulsations of a compressor according to claim 1, wherein the end portion of the partitioning section extends at least to halfway between the closest port section to the connecting opening and the second closest port section to the connecting opening.

5. A structure for damping the pressure pulsations of a compressor according to claim 2, wherein the divided chamber on the outer circumferential side is a discharge chamber, and the connecting opening is a discharge opening, and wherein the pressure pulsations are pulsations of discharge pressure of the compressor.

* * * * *